US005667087A

United States Patent [19]

Delatour et al.

[11] Patent Number: 5,667,087

[45] Date of Patent: Sep. 16, 1997

[54] CLOSURE AND SECURITY RING FOR CONTAINERS

[75] Inventors: Michel Delatour, Voiteur, France; Jean Servaux, La Tour-de-Peilz, Switzerland

[73] Assignee: Nestec S.A., Vevey, Switzerland

[21] Appl. No.: 265,323

[22] Filed: Jun. 24, 1994

[30] Foreign Application Priority Data

Jul. 12, 1993 [EP] European Pat. Off. ..... 93111110

[51] Int. Cl.[6] ..... B65D 55/08; B65D 41/34

[52] U.S. Cl. ..... 215/252; 215/258

[58] Field of Search ..... 215/251, 252, 215/230, 250, 253, 258; 220/276

[56] References Cited

U.S. PATENT DOCUMENTS

| | | | |
|---|---|---|---|
| 1,655,963 | 1/1928 | Lippert | 220/290 |
| 2,066,390 | 1/1937 | Cahoon et al. . | |
| 4,371,088 | 2/1983 | Gach . | |
| 4,527,701 | 7/1985 | Schaubeck . | |
| 4,546,892 | 10/1985 | Couput . | |
| 4,709,823 | 12/1987 | Beck et al. | 215/235 |
| 4,741,447 | 5/1988 | John . | |
| 4,759,456 | 7/1988 | Kusz | 215/252 |
| 4,957,211 | 9/1990 | Ekkert et al. . | |

FOREIGN PATENT DOCUMENTS

| | | |
|---|---|---|
| 52789 | 6/1945 | France . |
| 2290364 | 6/1974 | France . |
| 3722603 | 7/1988 | Germany . |
| WO9001925 | 3/1990 | WIPO . |
| WO9101925 | 2/1991 | WIPO . |

*Primary Examiner*—Allan N. Shoap
*Assistant Examiner*—Robin A. Hylton
*Attorney, Agent, or Firm*—Vogt & O'Donnell, LLP

[57] ABSTRACT

A security ring device to determine whether a container has been opened is integrated with a container and its cover. The security ring device has a rim which abuts the depending edge of the skirt of a container cover. The interior of the skirt has a portion which is provided with a perimeter groove. At least two lugs extend from the rim to the groove to lock the ring to the skirt. At least one lug extends from the rim to the container which has an outwardly extending flange portion positioned so that upon turning the cover to open the container, the at least one lug which extends from the rim to the container and establishes a tension for breaking the ring member. A collar may extend from the rim and abut the outer wall of the skirt. At least one weakened zone may be positioned in the rim ring to facilitate breaking.

21 Claims, 4 Drawing Sheets

CLOSURE AND SECURITY RING FOR CONTAINERS

BACKGROUND OF THE INVENTION

This invention relates to security rings for screw-threaded and snap-on closures for indicating whether a container has been opened.

Systems by which it is possible to see whether a pack has already been opened are well known. PCT Patent Application Publication No. WO 91/01925 relates to a closure for wide-necked containers comprising a cover with a security ring, the closure being mounted on the neck of the container. The principle of this tamper-proof closure system is based on the fact that, when the container is opened, the enlargement of the skirt of the closure cover deforms the security ring integral with the skirt which thus breaks at weakened points. This system offers a simple and safe way of telling whether a container has been opened. The disadvantage of this system is that it is designed for square Jars in which the security ring is broken by the deformation of the skirt of the cover. In the case of a round jar, there are no unlocking lugs on the neck of the container to deform the skirt of the cover. Accordingly, a solution based on a different principle has to be found.

SUMMARY OF THE INVENTION

The problem addressed by the present invention was to provide a system for visually showing whether a container with a screw cover or snap-on cover has been opened.

The present invention provides a security ring used for a closure comprising a rim with at least one locking lug and at least two detent lugs, and it may comprise a collar integral with the rim.

The advantage of the closure system according to the invention is that it enables already existing containers and covers to be retained. It is merely necessary to make the security ring which is then fitted to the cover. Since the container itself is filled and capped, all that remains is to place the closure system according to the invention on top of the container.

The device according to the invention may be used with particular advantage for containers of instant coffee, milk powder and other food products.

Thus, the present invention also relates to a screw-threaded closure for containers comprising a security ring integral with a cover designed to be fixed to the neck of the container, the cover comprising a base and a lateral skirt of which the inner wall comprises closure ramps forming a screwthread and designed to cooperate with corresponding closure ramps disposed on the outer part of the neck of the container, in which the security ring comprises a lower rim bearing against the lower edge of the skirt of the cover and comprising at least one locking lug and at least two detent lugs, the locking lug—in the closed position of the cover—bearing against a flange of the neck of the container situated beneath the closure ramps and the detent lugs being locked in a circular groove formed in the lower inner part of the skirt of the cover.

The present invention also relates to a snap-on closure for containers comprising a security ring integral with a cover designed to be fixed to the neck of the container, the cover comprising a base and a lateral skirt of which the inner wall comprises coupling means designed to cooperate with a flange on the outside of the neck of the container, in which the security ring comprises a lower rim bearing against the lower edge of the skirt of the cover and comprising at least one locking lug and at least two detent lugs, the locking lug—in the closed position of the cover—bearing against the flange on the outside of the neck of the container and the detent lugs being locked onto a serration provided in the lower inner part of the skirt of the cover.

DETAILED DESCRIPTION OF THE INVENTION

In the screw-on embodiment, the cover is preferably round and cooperates with a round neck, and in the snap-on embodiment, the cover is advantageously square in shape while the neck of the container is round.

In the screw-on embodiment, the skirt of the cover is not deformed when the cover is opened. The principle is based on the vertical displacement of the cover. When the container is opened, the locking lug bearing against the flange of the neck of the container fixed to it abuts against the flange. On the other hand, since the detent lug is locked onto the bottom of the skirt of the cover, it moves upwards with the cover, this vertical displacement of the cover creating a tension between the locking and detent lugs, which results in breakage of the security ring if the cover is removed from the container.

In one particular embodiment, the security ring comprises a collar integral with the rim and following the shape of the lower outer wall of the skirt of the cover. This collar enables the ring to be made more secure during handling.

In the snap-on embodiment, there is no collar because the ring does not have to deform when the cover is positioned on the container. By contrast, tension can be established in the ring during the upward movement of the cover at the moment of opening. The security ring preferably has two locking lugs and two detent lugs.

The security ring is in one piece and may be made by injection molding from a breakable material preferably based on polystyrene.

The cover is made separately from the security ring.

The configuration of the ring is such that the rings can be stacked which enables space to be saved. The rings may be supplied either individually or already mounted on the cover.

In the screw-on embodiment, a gap has to be provided on the inside of the skirt to create a sufficient space for the thickness of the locking and detent lugs when the cover is screwed onto the container.

When the container is opened, the security ring breaks and the fragments separate cleanly towards the outside. Accordingly, this affords the advantage that, after the initial opening, the ring is no longer on the container so that a conventional pack is formed.

The container is preferably made of glass with various neck diameters. The cover is a conventional cover comprising, for example, four locking ramps corresponding to the four ramps provided on the flange of the container. The cover is preferably made of polyethylene or polypropylene. The inner part of the base of the cover comprises a cardboard slip, a foam slip (expanded polyethylene) weldable by induction, a sealing ring applied in paste-like form which polymerizes in the ambient air or a barrier foam.

If the security ring with its collar is vertically cut, an L-shape is formed, the vertical part of the L being the collar of the ring which follows the shape of the lower outer wall of the skirt of the cover.

The locking and detent lugs are integral with the lower rim of the security ring, the lugs projecting obliquely towards the inside of the cover and towards to top of the container.

The above-mentioned lugs are in the form of small tongues with openings for reasons of elasticity, the locking tongue normally being longer than the detent tongue. The length of the locking tongue is determined by the distance separating the bottom of the skirt of the cover from the flange of the neck of the container.

The number of locking and detent lugs is crucial to the clean breakage of the security ring. Each security ring preferably has three each of these lugs. It is obvious that the lugs are normally distributed around the circumference of the ring in an alternating sequence, i.e., a locking lug, a detent lug, a locking lug and so on. However, this arrangement is not essential to establish the necessary breaking tension in the ring. If the lugs are uniformly distributed with three locking lugs, the locking lugs form an angle of 120° between one another in one and the same plane in the same way as the detent lugs.

Configurations with three locking lugs and three detent lugs are also possible and further facilitate breakage of the ring during opening of the container.

To ensure that the ring breaks between the above-mentioned lugs, it is preferable to provide weakened zones in the ring. These weakened zones may be formed by slots, for example U-shaped or V-shaped slots, their function being to establish around the periphery of the ring zones of reduced thickness or zones of reduced width with predetermined breakage zones.

In a first embodiment, the security ring comprises between each locking and detent lug at least one slot forming a weakened zone for the ring, the locking lug being formed by a single tongue.

In a second embodiment, each locking lug is formed by two tongues, a weakened zone being provided between the tongues.

The detent lugs each comprise a retaining catch which engages in the circular groove formed in the inner lower part of the skirt of the cover. This ensures total locking of the security ring on the cover.

The invention is described in detail in the following with reference to the accompanying drawings.

DETAILED DESCRIPTION OF THE DRAWINGS

Figure 1:
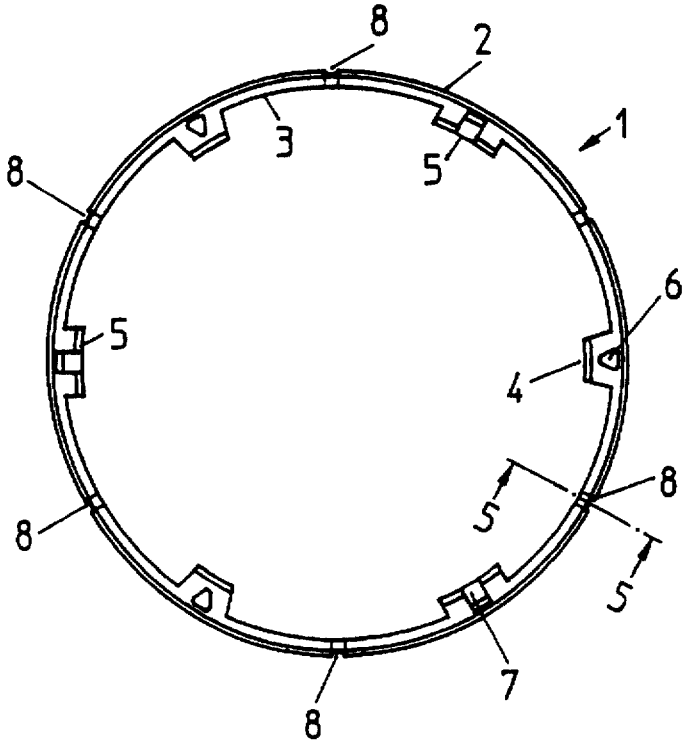
FIG. 1 is a plan view of the security ring.

As illustrated in FIG. 1, the security ring (1) comprises a collar (2) and a lower rim (3). The locking lugs (4) and the detent lugs (5) are integral with the lower rim. These lugs each comprise openings (6) and (7) so that they are highly elastic. The weakened zones (8) are positioned between the locking lugs and the detent lugs. The ring is made of polystyrene.

Figure 2:
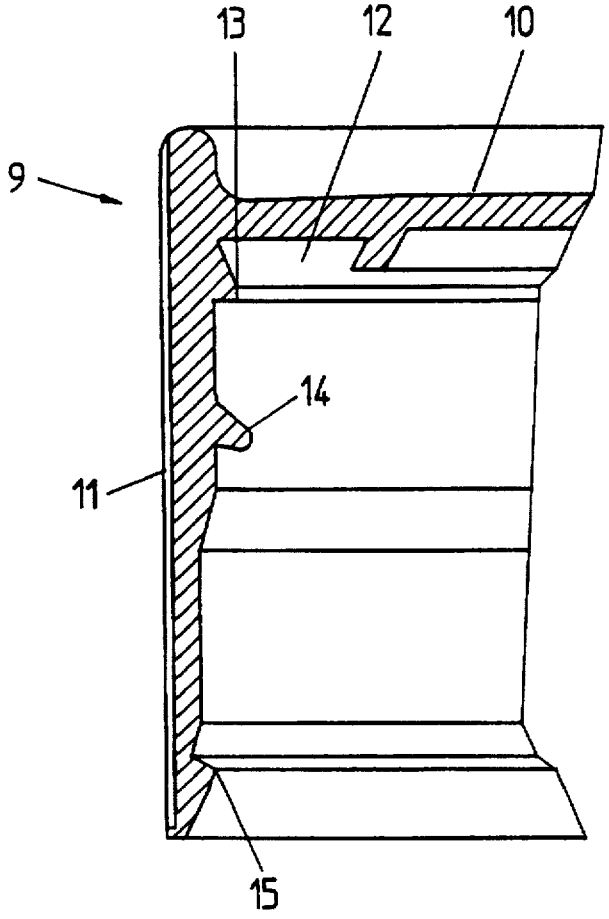
FIG. 2 is a partial section through the screw cover for the closure of the container.

FIG. 2 is a partial section through the container cover. The cover (9) comprises a base (10) and a lateral skirt (11). The inner part of the base of the cover comprises a zone (12) for accommodating a slip (not shown) which is held in place by means of the circular groove (13). The inner part of the lateral skirt comprises closure ramps (14) and a circular groove (15).

Figure 3:
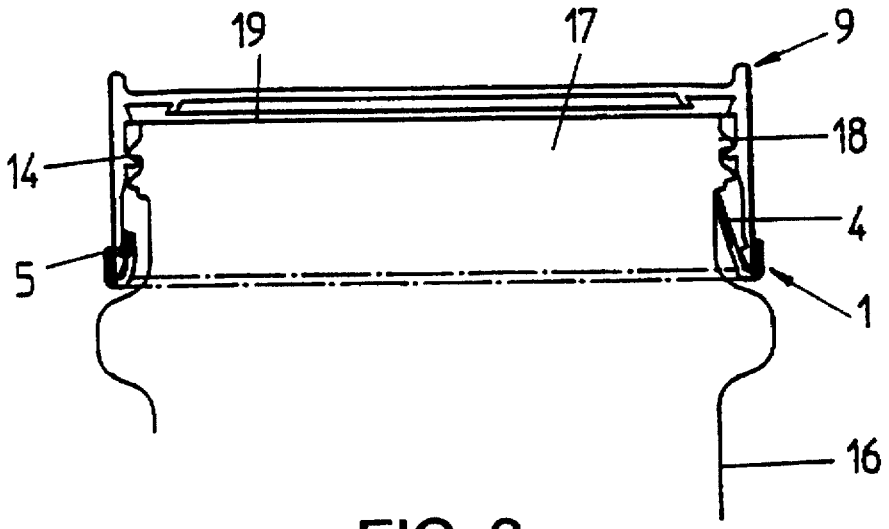
FIG. 3 diagrammatically illustrates the closure according to the invention mounted on a container.
Figure 4:
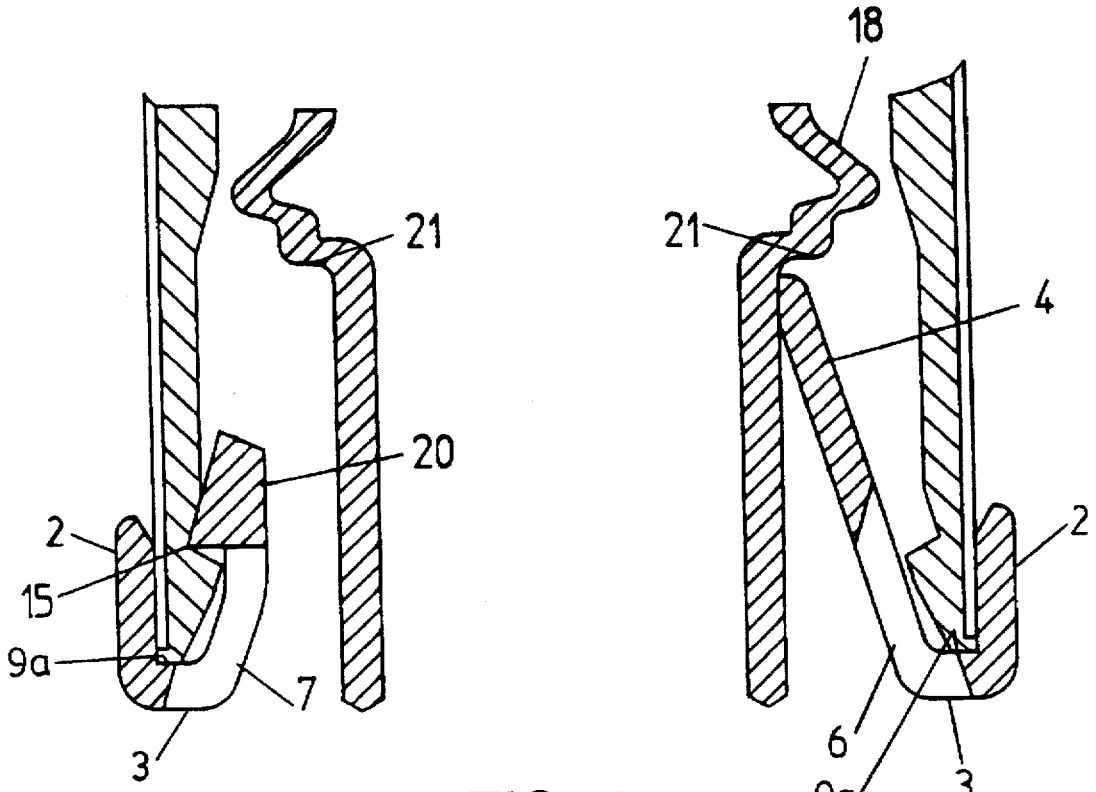
FIG. 4 is a section through part of FIG. 3.

FIGS. 3 and 4 show the combination of the elements illustrated in FIGS. 1 and 2. The container (16) to be closed comprises a neck (17) onto which the cover (9) integral with the security ring (1) is screwed. In the closed position of the container, the closure ramps (14) of the cover cooperate with corresponding closure ramps (18) of the neck of the container (16). The slip (19) in the cover bears against the upper flange of the neck of the container. The security ring (1) is locked onto the skirt of the cover by means of the detent lugs (5) comprising retaining tongues (20) which engage in the circular groove (15) of the skirt of the cover. The locking lugs (4) of the ring abut against a flange (21) of the neck of the container.

As will be noted from FIGS. 3 and 4, and with reference to FIGS. 1 and 3, the rim (3) has a surface which abuts the skirt edge (9*a*) and defines a rim width. Detent lugs (5), which terminate in the integral tongue (20) are integral with and extend from another surface of the ring rim (3), which defines a rim thickness, to project into cover groove (15) so that the lug (5) and its tongue (20) and the rim (3) abut the cover edge (9*a*) and groove (15). Locking lug (4) extends from the rim (3) to project towards the container so that upon turning the cover to open the container, lug (4) is restrained by flange (21) to establish a tension for breaking the ring member. As illustrated, lug (4) extends obliquely from the rim (3) to form an obtuse angle with respect to the rim surface adjacent cover edge (9*a*). As also illustrated, the collar (2) extends from the rim (3) transversely with respect to the rim surface adjacent cover edge (9*a*) so that spaces are formed between the collar and lugs and thus form a U-like shape.

When the container is opened, the cover (9) is unscrewed, moving upwards in the process. Since the detent lug (5) is completely locked onto the skirt of the cover and since the locking lug (4) presses against the flange (21), tension is established around the circumference of the security ring between each locking lug and detent lug. In the ring shown in FIG. 1, for example, there are six tension zones.

Figure 5:
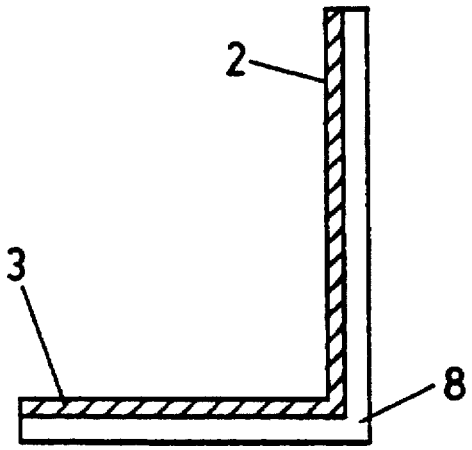
FIG. 5 is a section through the security ring on the line 5—5 of FIG. 1 showing the weakened zone.

Slots (8) (FIGS. 1 and 5) are provided in these zones, for example in the middle thereof. In the present case, six slots form zones of reduced thickness in the security ring at these places. The more the cover is lifted or unscrewed, the more the tension increases until ultimately the ring breaks in these weakened zones. In the present case, the slots are U-shaped. The system as a whole provided in this way makes it possible to tell safely whether the container has been opened. This is because, if the ring has really been broken, there is often a ring fragment which will have disappeared so that the consumer will be in a position to tell immediately whether the container has been opened.

Figure 6:
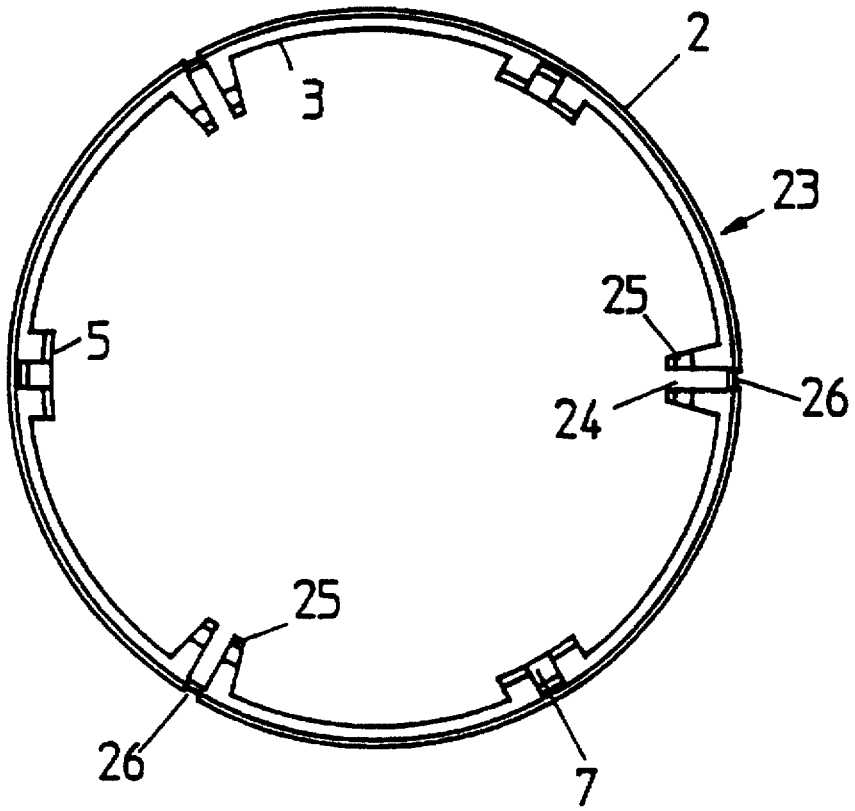
FIG. 6 is a plan view of the security ring in a second embodiment.

The only differences between the security ring (23) shown in FIG. 6 and that shown in FIG. 1 lies in the locking lugs (24) which, in this case, are formed by two identical tongues (25), the weakened zone (26) being situated between these two tongues and no longer between the locking and detent lugs. The other elements are denoted by the same reference numerals. The security ring will undergo the same tensions for the same reasons as before, except that it will break at the three weakened points (26).

Figure 7:
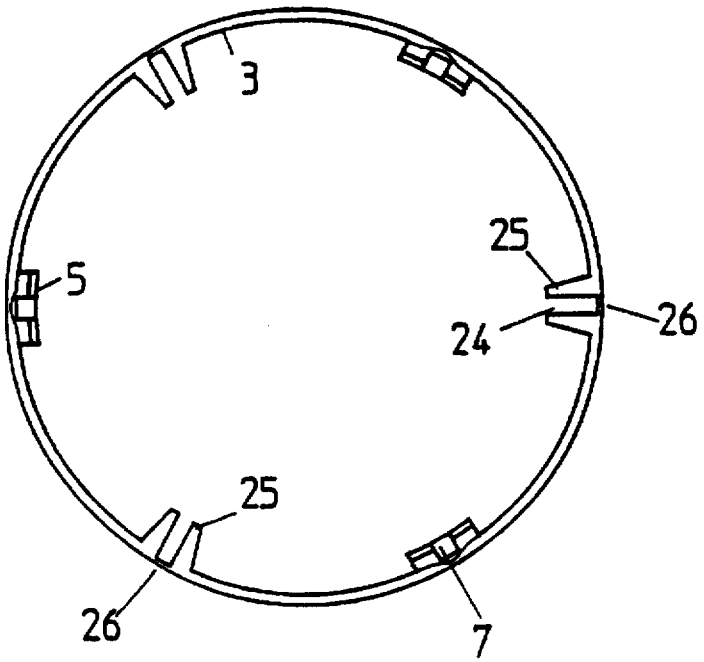
FIG. 7 is a plan view of the security ring in a third embodiment.

The only difference between FIG. 7 and FIG. 6 is that the security ring does not have a collar. However, the ring is designed to break in the same way as the ring shown in FIG. 6 at (26).

Figure 8:
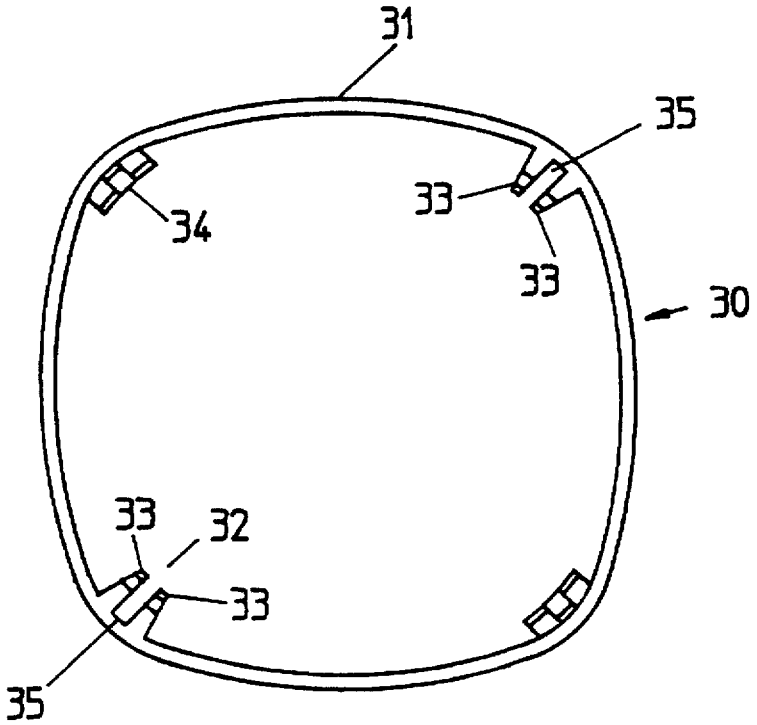
FIG. 8 is a plan view of the security ring for a container with a snap-on cover.

FIG. 8 shows a security ring (30) for a snap-on cover. In the same way as the screw covers, it comprises a lower rim (31) bearing locking lugs (32) formed by two identical tongues (33) and detent lugs (34). The weakened zone (35) is situated between the two tongues. The only difference between FIG. 8 and FIG. 7 lies in the geometric shape of the security ring which is round for the screw cover and square for the snap-on cover.

We claim:

1. In a container assembly having (i) a container outer surface having a round closure portion about a round container opening and having an outwardly extending flange portion positioned between the closure portion and a remainder of the container outer surface and wherein the closure portion has screw-thread ramps for engaging a screw-thread cover for providing for closing and opening the container and (ii) a cover having a first portion for covering the container opening and a round skirt portion which depends laterally from the first portion to a circular skirt edge to define, together with the first portion, a cover interior and wherein the skirt has screw-thread ramps positioned for engaging the container ramps for providing for closing and opening the container, the improvements comprising:

(i) a ring comprising a rim and two sets of spaced-apart lugs wherein the lug sets have differing shapes and wherein the lugs extend from the rim and (ii) a skirt interior portion which extends between the skirt edge and the cover screw-thread ramps and which contains a perimeter groove at a position displaced from the skirt edge and wherein the rim has a surface which abuts the skirt edge, wherein one lug set comprises two lugs which extend from the rim to the groove to lock the ring member to the skirt and wherein the second lug set comprises at least one lug which extends from the rim to the container and wherein the container and the cover and the second lug set are configured so that the flange is positioned between the cover screw-thread ramps and the edge, so that the interior skirt portion and the groove are spaced a distance away from the container remainder portion and so that upon turning the cover to open the container, the second lug set contacts the flange and establishes a tension for breaking the rim.

2. A container assembly according to claim 1 wherein the ring member further comprises a collar which extends from and about the rim and abuts an outer wall of the skirt.

3. A container assembly according to claim 2 further comprising at least one weakened zone positioned in the rim and collar.

4. A container assembly according to claim 2 further comprising a weakened zone positioned in the rim and collar at a position between one lug which extends to the groove and one lug which extends to the container.

5. A container assembly according to claim 2 wherein the lug which extends to the container comprises two portions separated by a gap and further comprising a weakened zone positioned in the rim and collar at a position between the two lug portions.

6. A container assembly according to claim 1 further comprising at least one weakened zone positioned in the rim.

7. A container assembly according to claims 2 or 6 wherein three lugs extend to the groove and three lugs extend to the container and are positioned in alternating sequence.

8. A container assembly according to claim 1 further comprising a weakened zone positioned in the rim at a position between one lug which extends to the groove and one lug which extends to the container.

9. A container assembly according to claim 1 wherein the lug which extends to the container comprises two portions separated by a gap and further comprising a weakened zone positioned in the rim at a position between the two lug portions.

10. A cover cap and security ring device assembly for a container comprising:

a cover comprising a first portion for covering a container opening and having a skirt portion which depends laterally from the first portion to a skirt edge to define, together with the first portion, a cover interior comprising an interior skirt portion and wherein the interior skirt portion comprises a groove at a position displaced a distance away from the skirt edge and comprises means for fixing the cover to a container neck at a position displaced a distance away from the skirt edge so that the skirt groove is at a position between the skirt edge and the fixing means;

a ring member comprising a rim wherein the rim comprises a first wall surface which defines a ring inner perimeter surface and which defines a rim thickness and wherein the rim comprises a second wall surface which extends transversely from the first wall surface, which defines a rim width and which is positioned to bear against the skirt edge; and two sets of spaced-apart lugs wherein the two lug sets have differing shapes and wherein the lugs extend from the first wall surface and wherein one lug set comprises two lugs which extend from the first wall surface to the skirt groove to lock the rim to the skirt and wherein the second lug set comprises at least one lug which extends from the first wall surface obliquely to form an obtuse angle with respect to the second wall surface.

11. An assembly according to claim 10 further comprising a collar which extends from the rim from a position adjacent the second wall surface in a direction transverse to the second wall surface so that there is space between the collar and the lugs.

12. An assembly according to claim 11 further comprising at least one weakened zone positioned in the rim and collar.

13. An assembly according to claim 10 further comprising at least one weakened zone positioned in the rim.

14. An assembly according to claims 13 or 12 wherein there are three lugs which extend to the groove and three lugs which extend obliquely positioned in alternating sequence.

15. An assembly according to claim 10 wherein the at least one lug which extends obliquely comprises two portions separated by a gap and further comprising a weakened zone positioned in the rim at a position between the two lug portions.

16. A security ring device for showing whether a container cover has been removed from a container comprising a rim comprising a plurality of surfaces and at least three lugs which comprise two sets of spaced-apart lugs having differing shapes and which extend from the rim, wherein the rim comprises a first wall surface which defines a ring inner perimeter surface about an open space and which defines a rim thickness and wherein the rim comprises a second wall surface which extends transversely from the first wall surface in a direction away from the open space and which defines a rim width and wherein the sets of lugs extend from the first wall surface in a direction so that the lugs extend beyond the second wall surface and wherein a first lug set comprises at least two lugs configured to form, together with the second wall surface, detent lug members and wherein the second lug set comprises at least one lug which extends from the first wall surface obliquely to form an obtuse angle with respect to the second wall surface.

17. A security ring device according to claim 16 further comprising a collar which extends from the rim from a position adjacent the second wall surface in a direction transverse to the second wall surface so that there is space between the collar and the lugs.

18. A security ring device according to claim 17 further comprising at least one weakened zone positioned in the rim and collar.

19. A security ring device according to claim 16 further comprising at least one weakened zone positioned in the rim.

20. A security ring device according to claims 19 or 18 wherein the first lug set comprises three lugs and the second lug set comprises three lugs, and the lugs of the two sets are positioned in alternating sequence.

21. A security ring device according to claim 18 wherein the at least one lug of the second lug set comprises two portions separated by a gap and further comprising a weakened zone positioned in the rim at a position between the two lug portions.

* * * * *